US009032968B2

(12) United States Patent
Glasberg et al.

(10) Patent No.: US 9,032,968 B2
(45) Date of Patent: May 19, 2015

(54) TIP CHARGING ELECTRONIC CIGARETTE AND SYSTEM AND METHOD FOR CHARGING THE SAME

(75) Inventors: Steve Glasberg, Glencoe, IL (US); Shigui Ren, Shenzhen (CN)

(73) Assignee: ECO-CIGS, INC., Skokie, IL (US)

( * ) Notice: Subject to any disclaimer, the term of this patent is extended or adjusted under 35 U.S.C. 154(b) by 0 days.

(21) Appl. No.: 13/820,722

(22) PCT Filed: Jul. 12, 2012

(86) PCT No.: PCT/CN2012/078542

§ 371 (c)(1), (2), (4) Date: Mar. 4, 2013

(87) PCT Pub. No.: WO2014/008646

PCT Pub. Date: Jan. 16, 2014

(65) Prior Publication Data

US 2014/0014124 A1 Jan. 16, 2014

(51) Int. Cl.
*A24F 47/00* (2006.01)

(52) U.S. Cl.
CPC ..... *A24F 47/008* (2013.01)

(58) Field of Classification Search
USPC ..... 320/114–115
See application file for complete search history.

(56) References Cited

U.S. PATENT DOCUMENTS

| | | | | |
|---|---|---|---|---|
| 5,052,943 | A * | 10/1991 | Davis | 439/357 |
| 7,832,410 | B2 | 11/2010 | Hon | |
| 8,156,944 | B2 | 4/2012 | Han | |
| 8,365,742 | B2 | 2/2013 | Hon | |
| 8,375,957 | B2 | 2/2013 | Hon | |
| 2006/0176017 | A1* | 8/2006 | Waguespack | 320/115 |
| 2006/0196518 | A1 | 9/2006 | Hon | |
| 2010/0031968 | A1 | 2/2010 | Sheikh et al. | |
| 2010/0164434 | A1* | 7/2010 | Cacioppo et al. | 320/115 |
| 2010/0200006 | A1* | 8/2010 | Robinson et al. | 131/194 |

(Continued)

FOREIGN PATENT DOCUMENTS

| | | | |
|---|---|---|---|
| CN | 201352950 | Y | 12/2009 |
| CN | 201393548 | Y | 2/2010 |
| CN | 201515249 | U | 6/2010 |
| JP | 2011087569 | | 6/2011 |

OTHER PUBLICATIONS

Written Opinion of International PCT Application No. PCT/CN2012/078542, mailed Mar. 28, 2013.

(Continued)

*Primary Examiner* — Richard Crispino
*Assistant Examiner* — Eric Yaary
(74) *Attorney, Agent, or Firm* — Marshall, Gerstein & Borun LLP

(57) ABSTRACT

A tip charging electronic cigarette includes a cigarette body including a shell and a mouthpiece, the shell having a forward portion terminating in a tip. The cigarette body further includes a battery, a charging circuit operatively coupled to the battery, and a cartomizer operatively coupled to a switch assembly. A center charging contact is disposed adjacent the tip, an annular charging contact is disposed adjacent the tip, and the center charging contact and the annular charging contact are operatively coupled to the charging circuit. The center charging contact and the annular charging contact are arranged for connection to cooperating electrical contacts of a charger assembly, wherein the battery is arranged to be charged upon engaging the tip with the charger assembly.

25 Claims, 10 Drawing Sheets

(56) References Cited

U.S. PATENT DOCUMENTS

| | | | | |
|---|---|---|---|---|
| 2010/0307518 | A1* | 12/2010 | Wang | 131/329 |
| 2011/0089891 | A1* | 4/2011 | Pai | 320/107 |
| 2011/0168194 | A1 | 7/2011 | Hon | |
| 2012/0090630 | A1 | 4/2012 | Hon | |
| 2012/0111347 | A1 | 5/2012 | Hon | |
| 2012/0234315 | A1 | 9/2012 | Li et al. | |
| 2012/0279512 | A1 | 11/2012 | Hon | |
| 2013/0228191 | A1* | 9/2013 | Newton | 131/329 |
| 2013/0284194 | A1* | 10/2013 | Newton | 131/329 |

OTHER PUBLICATIONS

International Search Report of International PCT Application No. PCT/CN2012/078542, mailed Mar. 28, 2013.

Notification of Transmittal of the International Search Report and the Written Opinion of the International Searching Authority or the Declaration for International PCT Application No. PCT/CN2012/078542, mailed Mar. 28, 2013.

* cited by examiner

TIP CHARGING ELECTRONIC CIGARETTE AND SYSTEM AND METHOD FOR CHARGING THE SAME

CROSS-REFERENCE TO RELATED APPLICATION

This is the United States National Phase under 35 USC §371 of International Application No. PCT/CN2012/078542 filed Jul. 12, 2012. The entire text of International Application No. PCT/CN2012/078542 is incorporated herein by reference.

BACKGROUND OF THE INVENTION

1. Field of the Disclosure

The present invention relates generally to electronic cigarettes and, more particularly, to front or tip charging electronic cigarettes, and to a system and method for tip charging an electronic cigarette.

2. Background of the Invention

Electronic cigarettes, or e-cigarettes, are gaining favor as an alternative to more traditional cigarettes. Electronic cigarettes may be used in some areas where smoking is disfavored, and consequently offer users an additional measure of flexibility regarding where the electronic cigarettes may be used.

Generally speaking, electronic cigarettes simulate the act of tobacco smoking by producing a nebulized or vaporized mist, which typically includes nicotine, although nicotine-free versions are also available. The mist or vapor produced by electronic cigarettes is inhaled in a manner similar to traditional smoking. According to many users, electronic cigarettes offer the same or similar appearance, feel, flavor and sensation of more conventional smoking.

Electronic cigarettes typically include a small liquid reservoir which carries the nicotine, a heating element, and a power source. The power source is most commonly a battery, although some electronic cigarettes may be wired to other power sources, such as a wired USB adapter or other suitable power source. Not only are electronic cigarettes portable and self-contained, they are intended to mimic the look and feel of traditional cigarettes. Moreover, many electronic cigarettes also are reusable when provided with replaceable and refillable components.

Electronic cigarettes most often include a rechargeable battery, which of course must be periodically recharged. Conventional systems require the user to partially disassemble the device in order to connect the battery to the charger. Consequently, users presently desire an easier and more convenient way to recharge the battery in electronic cigarettes.

SUMMARY OF THE DISCLOSURE

In accordance with one exemplary aspect, a tip charging electronic cigarette system comprises a cigarette body including a shell and a mouthpiece, with each of the shell and the mouthpiece having a forward portion and a rearward portion. The forward portion of the shell terminates in a tip, and the forward portion of the mouthpiece is removably coupled to the rearward portion of the shell. The cigarette body further includes a battery, a charging circuit operatively coupled to the battery, and a cartomizer operatively coupled to a switch assembly. The electronic cigarette includes a center charging contact disposed adjacent the tip, and an annular charging contact disposed adjacent the tip, with the center charging contact and the annular charging contact operatively coupled to the charging circuit. A charger assembly is arranged for connection to a power source, with the charger assembly having a cavity arranged to receive the forward portion of the shell, and with the charger assembly further including first and second electrical contacts disposed within the cavity, with the first electrical contact arranged to make electrical connection with the center charging contact and the second electrical contact arranged to make electrical connection with the annular charging contact to permit charging of the battery when the tip is disposed in the cavity of the charger assembly.

In accordance with a second exemplary aspect, a method of charging an electronic cigarette comprises providing a cigarette body including a shell, a mouthpiece, a battery, a charging circuit operatively coupled to the battery, and a cartomizer operatively coupled to a switch assembly, and providing a forward portion of the shell with a tip having a center charging contact and an annular charging contact, with both the center and annular charging contacts electrically coupled to the charging circuit and disposed adjacent the tip. The method further includes providing a charger assembly arranged for connection to a power source, with the charger assembly having a cavity arranged to receive the forward portion of the shell, and with the charger assembly including a first electrical contact disposed within the cavity and positioned to engage the center charging contact, the charger assembly further including a second electrical contact disposed within the cavity and positioned to engage the annular charging contact, coupling the charger assembly to a power source, and inserting the forward portion of the shell having the tip into the cavity of the charger assembly to bring the center and annular charging contacts of the tip into engagement with the first and second electrical contacts, respectively, of the charger assembly to charge the battery.

In accordance with a third exemplary aspect, a tip charging electronic cigarette comprises a cigarette body including a shell and a mouthpiece, the shell having a forward portion terminating in a tip. The cigarette body further includes a battery, a charging circuit operatively coupled to the battery, and a cartomizer operatively coupled to a switch assembly. A center charging contact is disposed adjacent the tip, an annular charging contact is disposed adjacent the tip, and the center charging contact and the annular charging contact are operatively coupled to the charging circuit. The center charging contact and the annular charging contact are arranged for connection to cooperating electrical contacts of a charger assembly, wherein the battery is arranged to be charged upon engaging the tip with the charger assembly.

In further accordance with any one or more of the foregoing first, second, third, or fourth aspects, a dual stage regulator and/or method may further include any one or more of the following preferred forms.

In some preferred forms, the cigarette body includes an air flow path extending from the shell, through the cartomizer, and to an aperture adjacent the rearward portion of the mouthpiece, and the cartomizer may be disposed in the mouthpiece and arranged to receive power from the battery via the switch assembly. The forward portion of the mouthpiece may include an inner contact and an outer contact, with the inner and outer contacts of the mouthpiece being electrically isolated from one another and electrically coupled to the cartomizer. The rearward portion of the shell may include an inner contact and an outer contact being electrically isolated from one another and electrically coupled to the switch assembly, with the inner contacts of the mouthpiece and the shell and the outer contacts of the mouthpiece and the shell, respectively, arranged to contact one another when the mouthpiece is attached to the shell. The air flow path may extend through inner contact of the mouthpiece and the inner contact of the rearward portion of the shell.

In further preferred forms, the charger assembly includes a USB connector. The first electrical contact of the charger assembly may include a spring-loaded pin. The forward portion of the shell may include an annular groove, and the charger assembly may include a detent arranged to engage the annular groove when the tip is disposed in the cavity of the charger assembly. The annular groove may be formed in the annular charging contact. Further, the detent may be resilient. The tip and the cavity may comprise magnets arranged to secure the forward portion of the shell with the cavity. The battery, the charging circuit, and the cartomizer may be disposed in the shell, and the switch assembly may comprise a pressure sensor disposed in the air flow path.

In still other preferred forms, the shell may include a light disposed adjacent the tip and the light may be visible at or through an area surrounding the center charging contact. The charger assembly may include a light arranged to indicate the battery is charging. Any one or more of the lights may be an LED.

In preferred method forms, the tip and the charger assembly may be provided with a detent mechanism, and the detent mechanism is engaged when placing the tip in the charger assembly. The tip and the cavity may be provided with cooperating magnets arranged to releasably secure the forward portion of the shell in the cavity.

In additional preferred method forms, the mouthpiece may be arranged to be removable from the shell, and the tip can be inserted into the charger assembly with the mouthpiece attached to the shell. An air flow path may be provided from the shell, through the cartomizer, and to an aperture adjacent a rearward portion of the mouthpiece. The cartomizer may be placed in the mouthpiece, and the cartomizer may be arranged to receive power from the battery via the switch assembly.

In further preferred method forms, a forward portion of the mouthpiece may be provided with an inner contact and an outer contact isolated from one another and electrically coupled to the cartomizer, and a rearward portion of the shell may be provided with an inner contact and an outer contact electrically isolated from one another and electrically coupled to the switch assembly. The various contacts are arranged to bring the inner and outer contacts of the mouthpiece and the shell, respectively, into contact with one another upon attaching the mouthpiece to the shell. The air flow path may be routed through the inner contact of the mouthpiece and the inner contact of the shell.

DETAILED DESCRIPTION

Although the following text sets forth a detailed description of one or more exemplary embodiments of the invention, it should be understood that the legal scope of the invention is defined by the words of the claims set forth at the end of this patent. The following detailed description is to be construed as exemplary only and does not describe every possible embodiment of the invention, as describing every possible embodiment would be impractical, if not impossible. Numerous alternative embodiments could be implemented, using either current technology or technology developed after the filing date of this patent, and such alternative embodiments would still fall within the scope of the claims defining the invention.

Figure 1B:
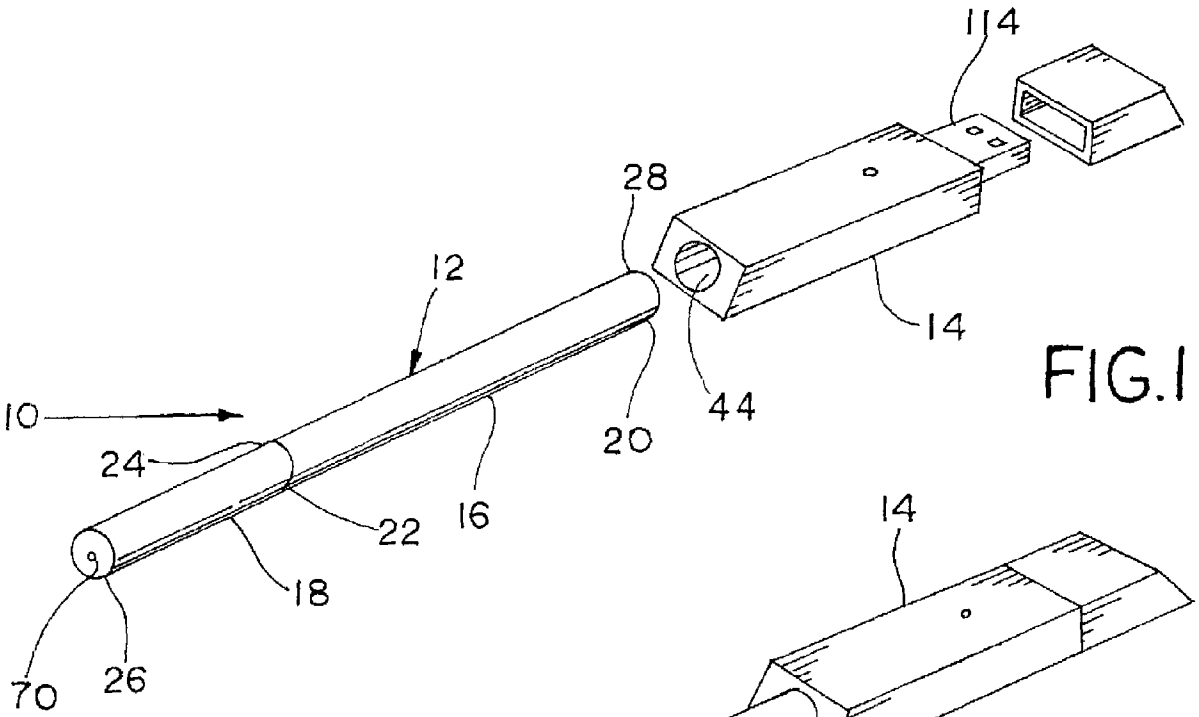
FIG. 1B is an elevational view of an electronic cigarette and charging assembly of FIG. 1A and showing the front or tip of the electronic cigarette inserted into the charger assembly.
Figure 1A:
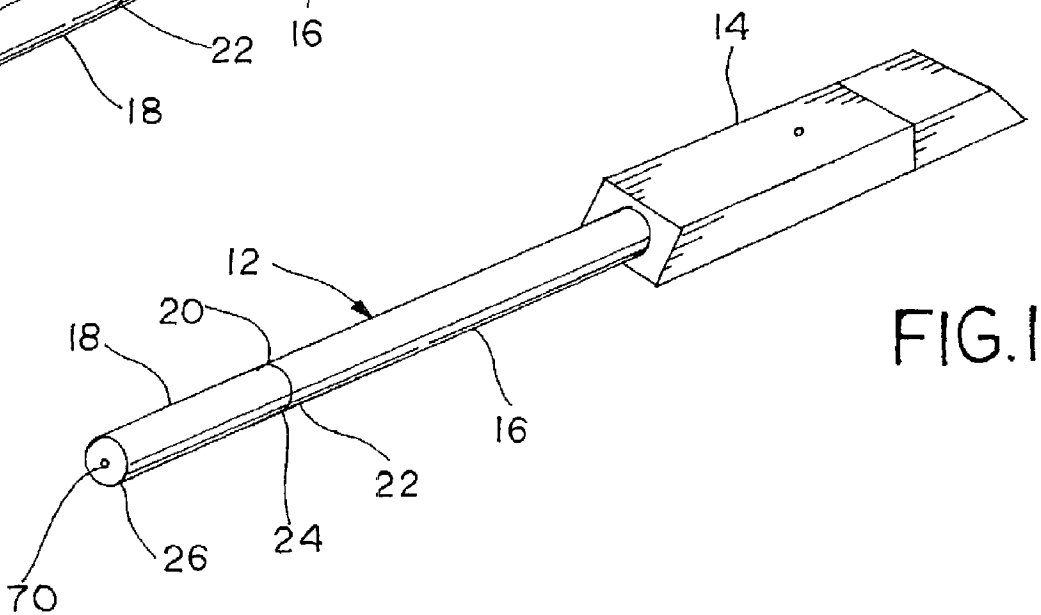
FIG. 1A is a perspective view of a tip charging electronic cigarette and charging system assembled in accordance with the teachings of a disclosed example of the present invention and showing the tip of the electronic cigarette in position for insertion into the charger assembly.

Referring now to the drawings, FIGS. 1A and 1B illustrate a tip charging electronic cigarette system which is generally referred to by the reference numeral 10. The electronic cigarette system 10 includes a cigarette body 12 and a charger assembly 14. The cigarette body 12 includes a shell 16 and a mouthpiece 18, which are preferably removably coupled or joined to one another using a threaded connection as will be explained in greater detail below, although other connections may prove suitable. The shell 16 includes a forward portion 20 (obscured in FIG. 1B but visible in FIG. 1A), and a rearward portion 22. Similarly, the mouthpiece 18 includes a forward portion 24 and a rearward portion 26. As shown in FIG. 1A, the forward portion 20 of the shell 16 terminates in a tip 28 (also obscured in FIG. 1B but visible in FIG. 1A). The tip 28 is shown in greater detail in FIGS. 2 and 3, and is described in greater detail below.

Figure 2:
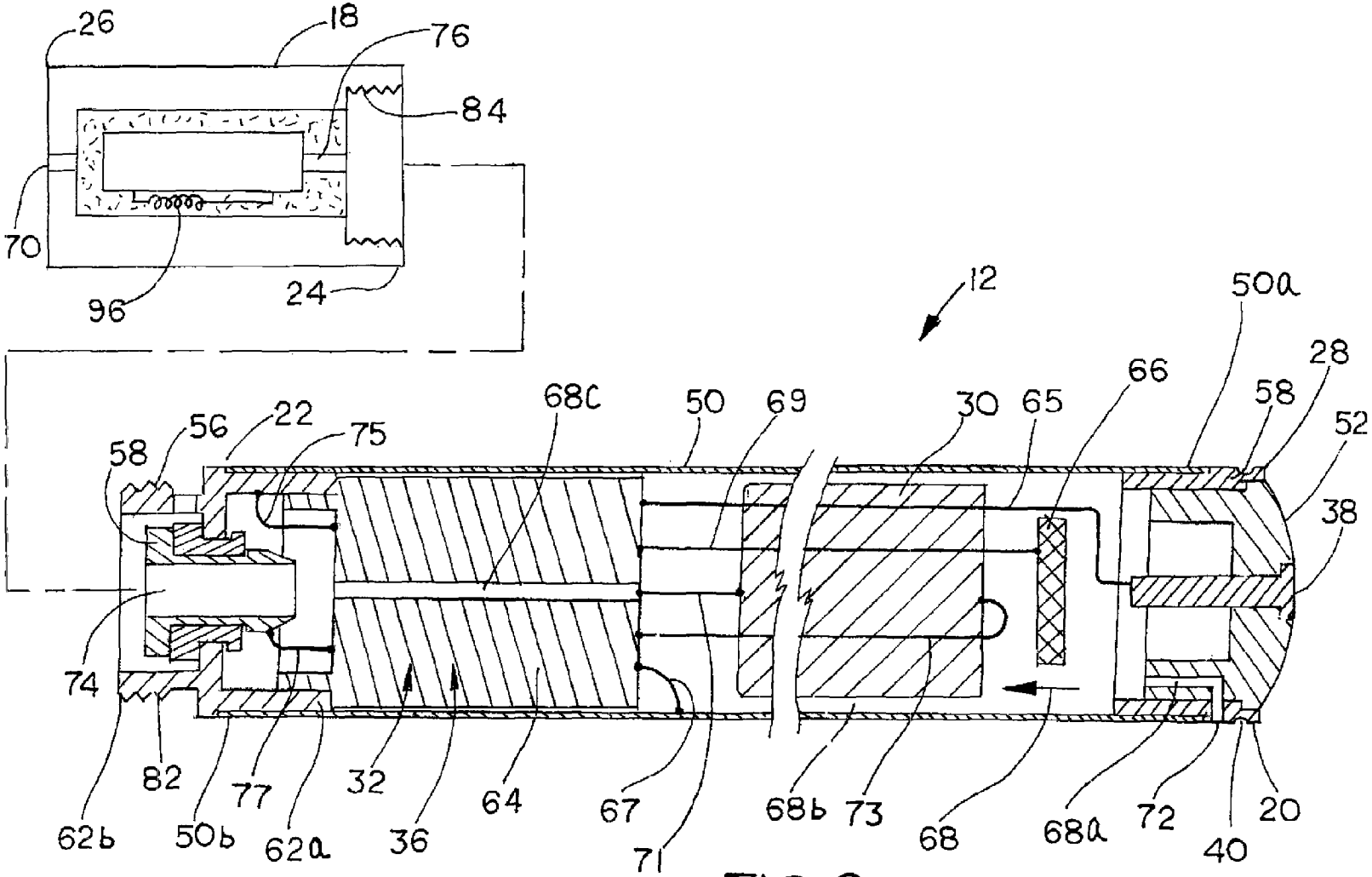
FIG. 2 is an enlarged cross-sectional view, partly exploded, of the electronic cigarette shown in FIG. 1 and illustrating the mouthpiece detached from the shell.
Figure 3:
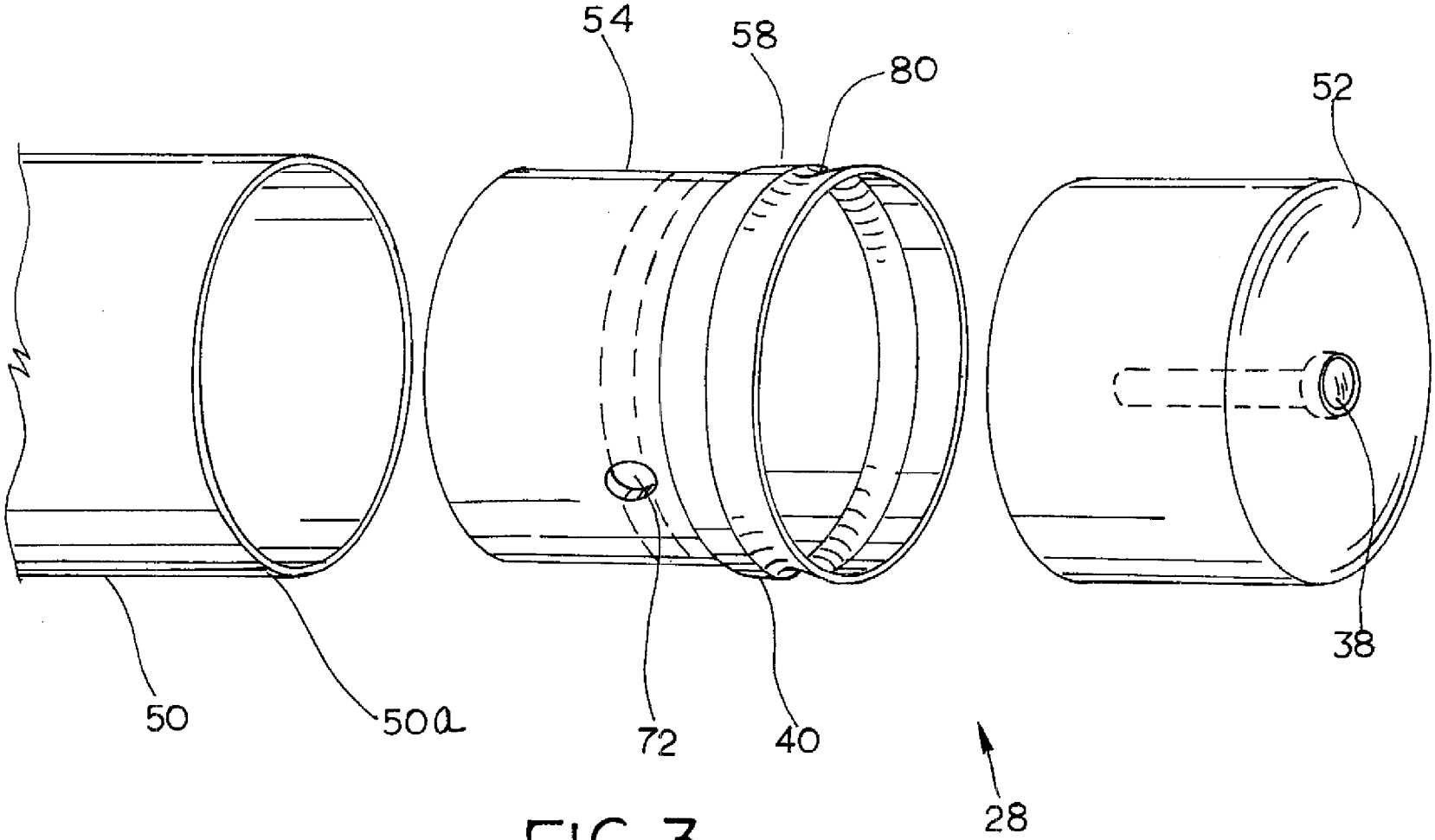
FIG. 3 is an enlarged fragmentary exploded view in perspective showing the forward portion of the shell terminating in the tip of the electronic cigarette.
Figure 10:
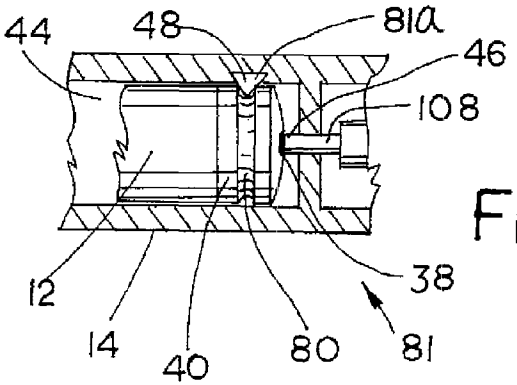
FIG. 10 is an enlarged fragmentary cross-sectional view of one exemplary retention mechanism in the form of a detent disposed inside the charger assembly.

As shown in greater detail in FIG. 2, the forward portion 24 of the mouthpiece 18 is removably coupled or otherwise removably attached or attachable to the rearward portion 22 of the shell 16. The cigarette body 12 includes a battery 30, a charging circuit 32 which is electrically connected or otherwise suitably operatively coupled to the battery 30, and a cartomizer 34 which is electrically connected or otherwise operatively coupled to a switch assembly 36. The charging circuit 32 and the switch assembly 36 are described in greater detail below with respect to FIG. 8. The cigarette body 12 further includes a center charging contact 38 disposed adjacent the tip 28, and also includes an annular charging contact 40 also disposed adjacent the tip 28. As can be seen in FIGS. 2, 3, and 10, the annular charging contact 40 defines an outer annular periphery of the tip 28. The central nature of the center charging contact 38, as well as the annular nature of the annular charging contact 40, can be seen to advantage in FIG. 3.

Figure 12:
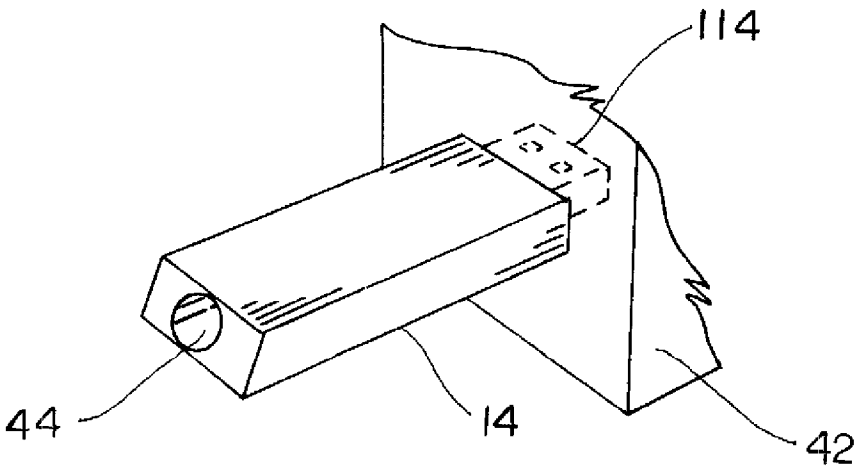
FIG. 12 is an enlarged fragmentary view in perspective showing the charger assembly connected via a USB connector to a USB port providing a power source for charging the battery.

Referring still to FIG. 2, the center charging contact 38 and the annular charging contact 40 are electrically connected or otherwise operatively coupled to the charging circuit 32. The charger assembly 14 is arranged for connection to a power source 42 (one exemplary power source 42 is shown in FIG. 12), and the charger assembly 14 includes a housing 15 forming a cavity 44 which is sized and positioned to receive the forward portion 20 of the shell 16. The charger assembly also preferably includes a removable cap 15*a*. As shown in FIG. 10, the charger assembly 14 includes a first electrical contact 46 and a second electrical contact 48, with the first and second electrical contacts 46 and 48 preferably being disposed within the cavity 44. The first electrical contact 46 is positioned within the cavity 44 so as to make an electrical connection with the center charging contact 38, while the second electrical contact 48 is positioned within the cavity 44 so as to make an electrical connection with the annular charging contact 40, when the tip 28 of the shell 16 is inserted into the cavity 44 of the charger assembly 14, to thereby permit charging of the battery when the tip is disposed in the cavity of the charger assembly and the charger assembly is connected to the power source 42.

Referring again to FIG. 2, the shell 16 is shown in greater detail. The shell 16 may be constructed from a cylinder 50 having a forward end 50*a* and a rearward end 50*b*. The cylinder 50 may be constructed of metal, such as aluminum, or from any other suitable material. At the forward end 50*a* of the cylinder 50, the center charging contact 38 is carried by an insert 52, and the insert 52 is sized to fit within the annular charging contact 40. The insert 52 is electrically nonconductive, such that the center charging contact 38 and the annular charging contact 40 are electrically insulated from one another. In the example shown, the annular charging contact 40 is formed by a metal ring 54 (shown in greater detail in FIG. 3), which is sized to be received and suitably secured within the end 50*a* of the cylinder 50. The shell 16 includes an outer electrical contact 56 disposed adjacent the rearward end 50*b*, and also includes an inner electrical contact 58 disposed adjacent the rearward end 50*b*. The outer and inner electrical contacts 56 and 58 are electrically isolated from one another by an insulator 60. The outer electrical contact 56 includes an end 62*a* sized for insertion within the end 50*b* of the cylinder 50, and also includes a threaded portion 62*b* which, in the disclosed example, protrudes from the cylinder 50.

The battery 30 and a circuit module 64 are disposed within the cylinder 50. In the disclosed example, the circuit module 64 includes the charging circuit 32 and the switch assembly 36, both of which are obscured in FIG. 2 but shown in detail in FIG. 8. Alternatively, the charging circuit 32 and the switch assembly 36 may be disposed within the cigarette body 12 in any suitable fashion, and may be disposed separately within the shell 16 without the use of the circuit module 64. A light 66, which may be an LED or any other suitable light source, is disposed within the cylinder 50 toward the end 50*a*, and preferably is disposed behind the insert 52. Still preferably, the insert 52 is sufficiently transparent or translucent to allow the light 66 to be visible through the insert 52 when the light 66 is activated.

An air flow path 68 extends through the cigarette body 12. The air flow path 68 enters the shell 16 and hence the cigarette body 12 at any suitable location, extends to the cartomizer 34, and eventually exits the cigarette body 12 via an aperture 70 in the mouthpiece 18. In the example shown, the air flow path 68 includes at least one inlet aperture 72 which, in the disclosed example, is formed through the metal ring 58 that forms the annular charging contact 40. Alternatively, the inlet aperture 72 may be formed in any suitable location. A portion 68*a* (shown schematically in FIG. 2) of the air flow path 68 extends into and through the tip 28. Another portion 68*b* of the air flow path 68 extends through a designated path or any available space within the cylinder 50 to extend past the battery 30, through another portion 68*c* through the circuit module 64 (shown schematically in FIG. 2), and to an aperture 74 leading out of the shell 16. The flow path 68 continues from the aperture 74 into an inlet aperture 76 in the mouthpiece 18, or the flow path 68 passes through the cartomizer 34 and exits the exit aperture 70 (visible in FIGS. 2 and 6) in the mouthpiece 18. Those of skill in the art will understand that the air flow path 68 may be formed variety of ways, as long as air is suitably routed past/through the cartomizer 34. In the example shown, the aperture 74 exiting the shell 16 is formed by or through the inner electrical contact 58, while the aperture 76 is formed by or through the inner electrical contact of the mouthpiece 18 as will be shown and described in greater detail below.

As is also shown in FIG. 2, the center charging contact 38 is electrically connected to the circuit module 64 by a connector 65, while the annular charging contact 40 is connected to the circuit module 64 via the cylinder 50 and a connector 67. The light 66 is connected to the circuit module 64 by a connector 69 while the battery 30 is connected to the circuit module 64 via a pair of connectors 71 and 73. The outer electrical contact 56 is connected to the circuit module 64 via a connector 75, while the inner electrical contact is connected to the circuit module 64 by a connector 77. The connectors 67 and 75 act as grounds to the shell 50. Additional details of the circuitry will be explained below with respect to FIG. 8.

Figure 11:
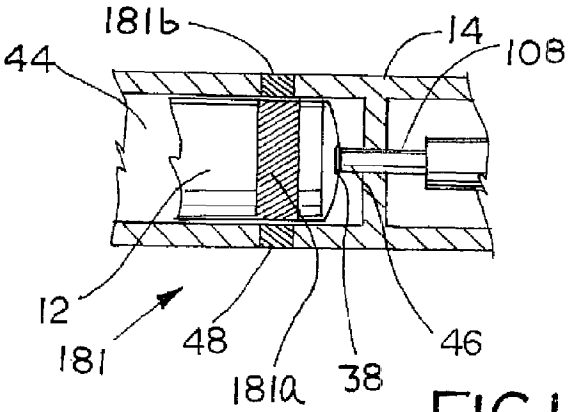
FIG. 11 is an enlarged fragmentary cross-sectional view of another exemplary retention mechanism in the form of one or more magnets disposed inside the charger assembly.

Referring now to FIG. 3, in the example shown therein the metal ring 54 that forms the annular charging contact 40 preferably includes an annular groove 80. The annular groove 80 engages a cooperating retention mechanism 81 which, in the example of FIGS. 9 and 10 takes the form of a detent 81*a* disposed inside the charger assembly 14 as will be explained below. Preferably the detent is resilient or spring loaded so as to provide a positive connection when the tip 28 of the cigarette body is inserted into the charger assembly 14. An alternative retention mechanism 181 is shown in FIG. 11 and will be discussed in greater detail below, and may be magnetic and may include one or more magnets carried by the tip 28 and/or the charger assembly 14. Regardless of whether the tip 28 is retained in the charger by the retention mechanism 81 or 181, the tip 28 and the charger assembly 14 preferably cooperate to retain the charging contacts 38 and 40 of the tip 28 in contact with the contacts 46 and 48, respectively, of the charger assembly 14, such that the power is made available from the power source 42 to charge the battery 30.

Figure 4:
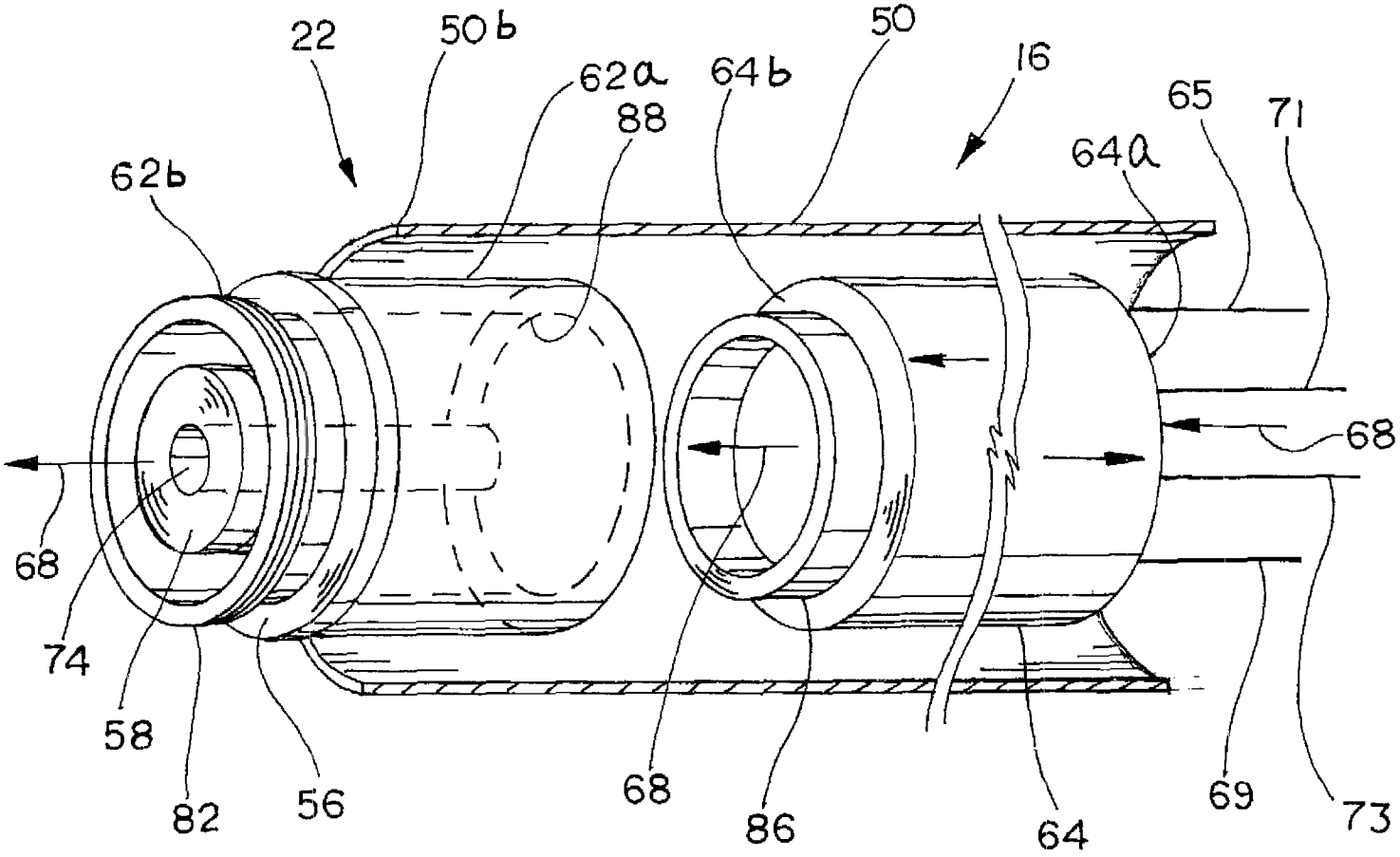
FIG. 4 is an enlarged fragmentary exploded view in perspective showing the electrical contacts, the air flow path, and the switch assembly, all which are disposed adjacent the rearward end of the shell.

FIG. 4 shows, in partly exploded form, the rearward portion 22 of the shell 16 (including a cutaway portion of the cylinder 50 shown slightly expanded), the outer electrical contact 56, the inner electrical contact 58, the circuit module 64, and the aperture 74 forming a portion of the flow path 68. In the example shown, the outer electrical contact 56 includes a threaded connection 82, which cooperates with a threaded connection 84 carried by the forward portion 24 of the mouthpiece 18 (the threaded connection is not shown in FIG. 4, but is visible in FIGS. 2, 6 and 7). The circuit module 64 includes a forward end 64*a* and a rearward end 64*b*. In the arrangement shown, the rearward end 64*b* of the circuit module 64 includes a protrusion 86 which is sized to engage a recess 88 in the forward end 62*a* of the outer electrical contact 56, such that the circuit module 64 and the outer electrical contact 56 are nested together. Alternatively, the circuit module 64 may be disposed within the body 12 in any desirable location. In the disclosed example, a portion of the air flow path 68 extends through both the circuit module 64 and the inner electrical contact 58.

Figure 5:
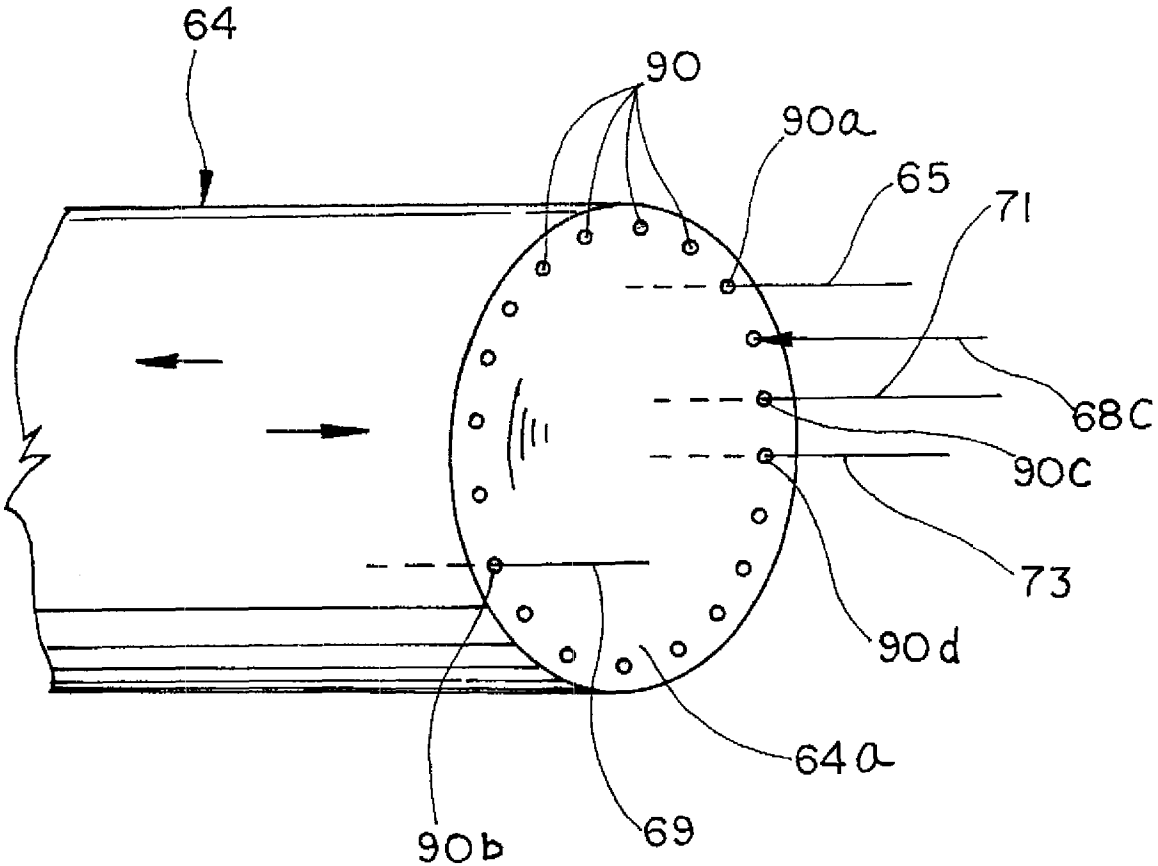
FIG. 5 is an enlarged fragmentary view in perspective showing the forward end of the switch assembly and illustrating various connecting wires that extend into the switch assembly.

FIG. 5 shows the forward end 64*a* of the circuit module 64 in greater detail. The forward end 64*a* of the circuit module 64 preferably includes one or more apertures 90. In accordance with the disclosed example, one or more of the apertures 90 form all or a portion of the portion 68*c* of the air flow path 68 that flows through the circuit module 64. Alternatively, the portion 68*c* of the air flow path 68 may be routed around the circuit module 64 in any suitable fashion. One or more of the apertures 90 also may be used to route the appropriate connectors 65, 69, 71 and 73 into the circuit module 64. In the example shown, the connector 65 extends through an aperture 90*a* to the circuit module 64, the connector 69 extends through an aperture 90*b* to the circuit module 64, the connector 71 extends through an aperture 90*c* to the circuit module 64, and the connector 73 extends through an aperture 90*d* to the circuit module 64. Alternatively, the connectors 65, 69, 71 and 73 may be routed to their appropriate circuits or components in any suitable fashion.

Figure 6:
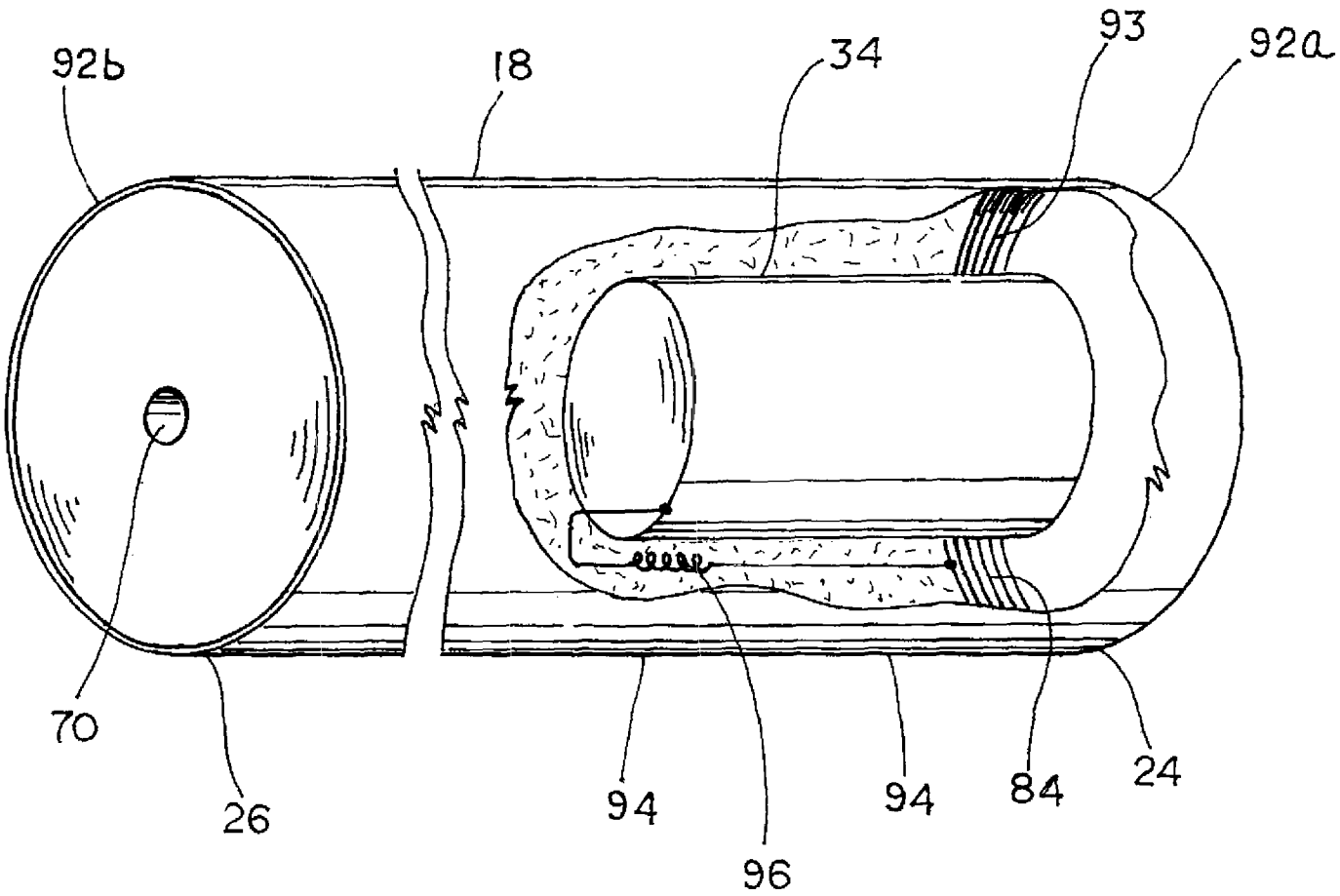
FIG. 6 is an enlarged perspective view of the mouthpiece with portions of the mouthpiece cutaway to reveal the cartomizer.
Figure 7:
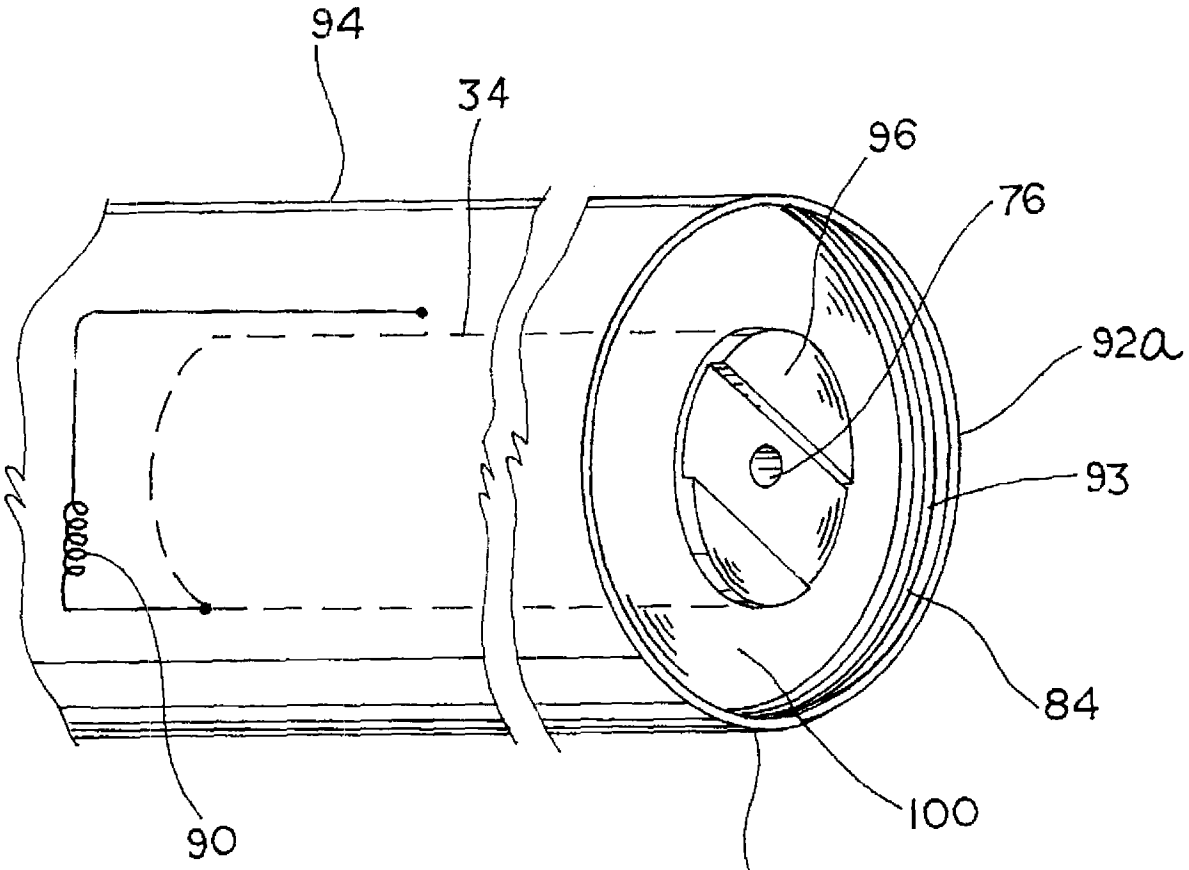
FIG. 7 is an enlarged fragmentary perspective view of the front and of the mouthpiece and showing the electrical contacts and a portion of the air flow path.

FIGS. 6 and 7 show the mouthpiece 18 in greater detail. The mouthpiece 18 includes a forward end 92*a* and a rearward end 92*b*. As outlined above, in the example shown the cartomizer 34 is disposed within the mouthpiece 18. Other locations for the cartomizer 34 may prove suitable. The cartomizer 34 may be conventional, and includes a reservoir 94, preferably surrounded by wadding, and a heating element 96. The heating element 96 receives power from the battery 30 via a suitable circuit 102 (discussed in greater detail below with respect to FIG. 8), and the heating element 96 generates heat to vaporize a propylene glycol- or glycerin-based liquid solution into an aerosol mist. The liquid solution preferably includes nicotine. Other carrier solutions may be contemplated, and other any other forms for the cartomizer may prove suitable.

The mouthpiece 18 may be constructed from a cylinder 94 forming the forward end 92*a* and the rearward end 92*b*. The cylinder 94 may be constructed of metal, such as aluminum, or from any other suitable material. The mouthpiece 18 includes a center contact 96 adjacent the forward end 92*a* of the cylinder 94. In the example, shown, the center contact includes the aperture 76. The aperture 76 is in flow communication with the aperture 70 at the rearward end 92*b* in any suitable manner, and thus forms a portion of the air flow path 28. In the disclosed example, the cylinder 94 itself forms an outer contact 98, and the inner and outer contacts 96, 98 are electrically isolated from one another using any suitable insulator 100. The threaded connection 84 is formed adjacent the forward end 92*a* in any suitable manner. In the example shown, the forward end 92*a* and/or the threaded connection 84 form the outer contact 98.

Figure 8:
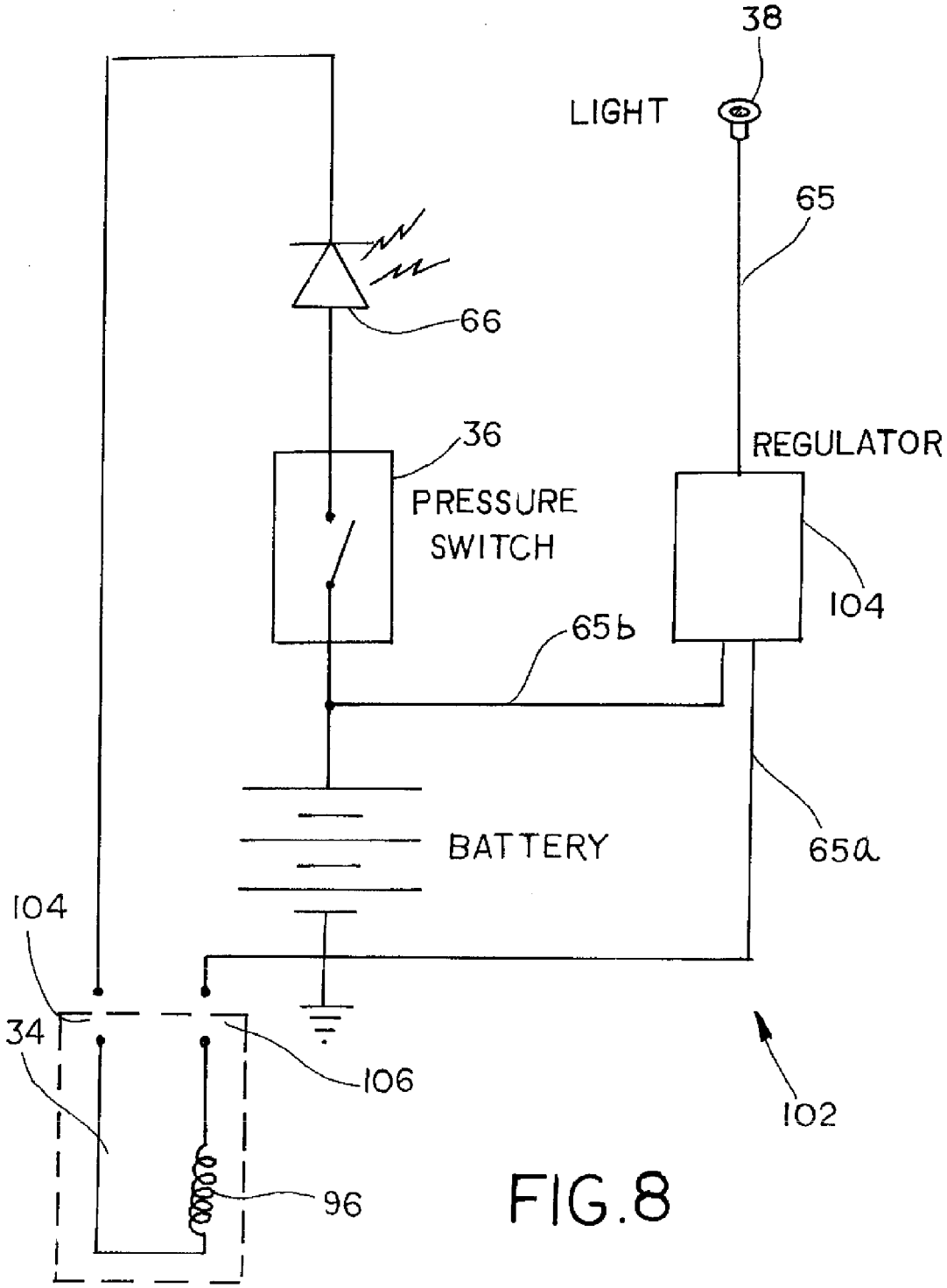
FIG. 8 is a schematic diagram of an exemplary circuit for controlling activation and/or charging of the electronic cigarette.

FIG. 8 illustrates an exemplary circuit 102 incorporating the battery 30, the charging circuit 32, the cartomizer 34, the switch assembly 36, and the light 66 for use in the tip charging electronic cigarette system 10. In the disclosed example, the charging circuit 32 includes a power regulator 104 for regulating the amount of power that flows to the battery 30. The power regulator 104 is connected to the center charging contact 38 by the connection 65, and the power regulator 104 in turn is connected to the battery 30 by connections 65*a* and 65*b*. The circuit 102 includes the switch assembly 36 which is responsive to air pressure or air flow along or through the air flow path 28. The switch assembly 36 may be any one of a number of air pressure or air flow switches including, but not limited to, a vane switch. The light 66 is coupled to the battery 30 via the switch assembly 36, which ultimately activates the circuit 102 when air or air pressure is sensed at the switch assembly. Ultimately, power is routed to the cartomizer 34 and hence to the heating element 96 via suitable connections 104 and 106. The connection 104 is formed by contact between the outer contact 56 carried by the rearward end 50*b* of the cylinder 50/shell 16 and the outer contact 98 carried by the mouthpiece 18. The connection 106 is formed by contact between the inner contact 58 carried by the rearward end 50*b* of the cylinder 50/shell 16 and the contact 96 carried by or adjacent the forward end 92*a* of the mouthpiece 18.

The electrical components shown in FIG. 8 may be suitably disposed within the body 12 and/or the shell 16 in any suitable manner. In the disclosed example, the cartomizer 34 that is disposed in the mouthpiece 18. Other configurations may be contemplated. Also, those of skill in the art will readily understand that the circuit 102 may include or take the form of any other suitable circuit that, for example, may control overcharging of the battery 30 or that may prevent damage to the circuit 102 should a wrong polarity voltage be applied at the charging contact 38.

Figure 9:
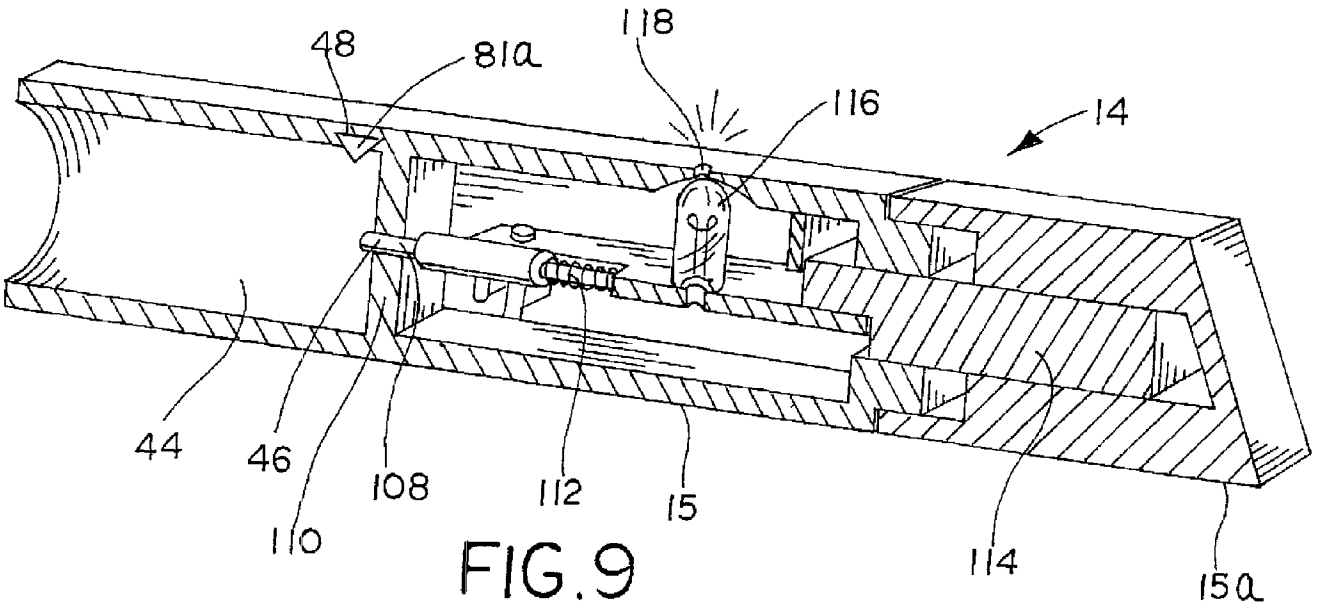
FIG. 9 is a cross-sectional view in perspective of the charger assembly.

Referring now to FIG. 9 the charger assembly 14 is shown in greater detail. The charger assembly 14 includes a charging pin 108 disposed so as to protrude through a panel 110 and into cavity 44. In the example shown, the charging pin 108 is coupled to a spring 112. The charging pin 108 is also electrically coupled to a suitable pin or connector disposed inside a USB connector 114. The cavity 44 includes another connector 116, which also is electrically coupled to a suitable pin or connector disposed inside the USB connector 114. The connection between the charging pin 108, and suitable pin or connector of the USB connector 114, as well as the connection between the connector 116 and the suitable pin or connector of the USB connector 114 are not shown, but both would be conventional and readily achievable by those of skill in the art. The charger assembly 14 preferably includes a light 116 visible through an aperture 118 in the charger assembly 14. The light 116 preferably is energized when the USB connector 114 is connected to a suitable power source 42 as shown in FIG. 12.

Referring now to FIG. 10, the retention mechanism 81 may be constructed from the detent 81*a*, which is positioned within the cavity 44 of the charger assembly 14 so as to engage the annular groove 80, which forms, the outer charging contact 40 adjacent the tip 28 of the electronic cigarette 12. As the detent 81*a* is preferably resilient, the user can push the tip 28 into the cavity 44 until the tip 28 forces the detent 81*a* over the end of the electronic cigarette 12 until the detent 81*a* falls into the annular groove 80. The detent 81*a* may form the contact 48. Alternatively, the contact 48 and the detent 81*a* may be separate. Consequently, the charging contact 38 is in contact with the charging pin 108, while the outer charging contact 40 is in contact with the contact 48/detent 81*a*. As both the charging pin 108 and the contact 48/detent 81*a* are suitably coupled to the USB connector 114, power from the power source 42 is routed to the appropriate contacts, thus allowing power to be routed to the battery via the circuit 102 as outlined above.

Referring now to FIG. 11, the retention mechanism 181 may be constructed from suitable magnetic components. For example, the retention mechanism 181 may include a magnet 181*a* carried adjacent the tip 28 of the electronic cigarette 12, and a cooperating magnet 181*b* carried within the cavity 44 of the charger assembly 14. The magnet 181*b* may form the contact 48, and thus may be suitably connected to the USB connector 114. Alternatively, the contact 48 and the magnet 181*b* may be separate, in which case the contact 48 is connected to the USB connector 114. Those of skill in the art may contemplate additional alternatives, such as by providing a magnet within the charger assembly 14 conjunction with a steel component adjacent the tip 28 of the electronic cigarette 12, or the magnet 181*a* in conjunction with a steel portion disposed within the cavity 44 of the charger assembly 14. Still other alternatives may be contemplated, as long as there is sufficient magnetic force so as to suitably retain electronic cigarette 12 the cavity 44, with electrical contact suitable to allow power to be routed to the battery via the circuit 102 as outlined above.

In operation, the user (not shown) places the mouthpiece 18 of the electronic cigarette 12 into his or her mouth and draws air through the air flow path 18. The resultant changes in airflow or air pressure causes the switch assembly 36 to close, thus energizing the heating element 96 of the cartomizer 34. Consequently, the heating element 96 vaporizes a portion of the carrier liquid disposed within the cartomizer 34, allowing the user to draw the vapor through the aperture 70. When the switch assembly 36 is closed and the circuit 102 is energized, power from the battery 30 is also routed to the light 66, causing the light to energize. Because the inserts 52 is suitably transparent or translucent, the light 66 is visible from the end of the electronic cigarette 12, thus visually simulating a more traditional smoking device in a pleasing manner.

When the power level in the battery 30 is depleted or undesirably diminished, the user may insert the tip 28 of the electronic cigarette 12 into the cavity 44 of the charger assembly 14 in the manner shown in either FIG. 10 or FIG. 11. In either form, the center charging contact 38 makes contact with contact 46/charging pin 108, while the outer contact 40 makes contact with the contact 48/detent 81*a* (or the contact 181*b*), thus charging the battery. As shown in FIG. 12, the charger assembly 14 may be coupled to a suitable power source 116, such as a computer, a 12V power source via a suitable adapter, or to any other suitable power source.

While certain representative embodiments and details have been shown for purposes of illustrating the invention, it will be apparent to those skilled in the art that various changes in the methods and apparatus disclosed herein may be made without departing from the scope of the invention.

The invention claimed is:

1. A tip charging electronic cigarette system, the system comprising:

a cigarette body, the cigarette body including a shell and a mouthpiece, each of the shell and the mouthpiece having a forward portion and a rearward portion, the forward portion of the shell terminating in a tip, the forward portion of the mouthpiece removably coupled to the rearward portion of the shell;

the cigarette body further including a battery, a charging circuit operatively coupled to the battery, and a cartomizer operatively coupled to a switch assembly, wherein the battery is carried by the shell, and the cartomizer is carried by the mouthpiece so as to be separable from the shell and the battery upon removing the mouthpiece from the shell;

a center charging contact carried by an insert and disposed at the tip, wherein the insert radially surrounds the center charging contact;

an annular charging contact disposed adjacent the tip and defining an outer annular periphery of the tip, the annular charging contact radially surrounding and carrying the insert and being separated from the center charging contact by the insert, the insert being electrically non-conductive, such that the center charging contact and the annular charging contact are electrically insulated from one another;

the center charging contact and the annular charging contact operatively coupled to the charging circuit;

a light disposed behind the insert, the light being operatively coupled to the charging circuit, and the insert being one of transparent or translucent to permit the light to be visible through the insert when activated; and a charger assembly arranged for connection to a power source, the charger assembly having a cavity arranged to receive the forward portion of the shell, the charger assembly further including first and second electrical contacts disposed within the cavity, the first electrical contact arranged to make electrical connection with the center charging contact and the second electrical contact arranged to make electrical connection with the annular charging contact to permit charging of the battery when the tip is disposed in the cavity of the charger assembly, wherein the insert holds the center charging contact and the annular charging contact in a fixed position at the tip relative to the shell; and wherein the forward portion of the shell includes an annular groove, wherein the annular groove is formed in the annular charging contact, and wherein the charger assembly includes a detent arranged to engage the annular groove when the tip is disposed in the cavity of the charger assembly.

2. The electronic cigarette system of claim 1, wherein the cigarette body includes an air flow path extending from the shell, through the cartomizer, and to an aperture adjacent the rearward portion of the mouthpiece, and wherein the cartomizer is disposed in the mouthpiece and is arranged to receive power from the battery via the switch assembly.

3. The electronic cigarette system of claim 2, wherein the forward portion of the mouthpiece includes an inner contact and an outer contact, the inner and outer contact of the mouthpiece electrically isolated from one another and electrically coupled to the cartomizer, and wherein the rearward portion of the shell includes an inner contact and an outer contact electrically isolated from one another and electrically coupled to the switch assembly, the inner contacts of the mouthpiece and the shell and the outer contacts of the mouthpiece and the shell respectively arranged to contact one another when the mouthpiece is attached to the shell.

4. The electronic cigarette assembly of claim 3, wherein the air flow path extends through inner contact of the mouthpiece and the inner contact of the rearward portion of the shell.

5. The electronic cigarette system of claim 1, wherein the charger assembly includes a USB connector.

6. The electronic cigarette system of claim 1, wherein the first electrical contact of the charger assembly includes a spring-loaded pin.

7. The electronic cigarette assembly of claim 1, wherein the detent is resilient.

8. The electronic cigarette assembly of claim 1, wherein the tip and the cavity comprise magnets arranged to secure the forward portion of the shell with the cavity.

9. The electronic cigarette assembly of claim 1, wherein the battery, the charging circuit, and the cartomizer are disposed in the shell, and wherein the switch assembly comprises a pressure sensor disposed in an air flow path.

10. The electronic cigarette assembly of claim 1, the light, when activated, being visible at an area surrounding the center charging contact.

11. The electronic cigarette assembly of claim 10, wherein the light is an LED.

12. The electronic cigarette assembly of claim 1, wherein the charger assembly includes a light arranged to indicate the battery is charging.

13. A method of charging an electronic cigarette, the comprising:

providing a cigarette body, the cigarette body including a shell, a mouthpiece, a battery, a charging circuit operatively coupled to the battery, and a cartomizer operatively coupled to a switch assembly, wherein the battery is carried by the shell, and the cartomizer is carried by the mouthpiece so as to be separable from the shell and the battery upon removing the mouthpiece from the shell;

providing a forward portion of the shell with a tip having a center charging contact carried by an insert and an annular charging contact, the annular charging contact defining an outer annular periphery of the tip and radially surrounding and carrying the insert and being separated from the center charging contact by the insert, the insert being electrically non-conductive such that the center charging contact and the annular charging contact are electrically isolated from one another, both the center and annular charging contacts electrically coupled to the charging circuit and disposed adjacent the tip, wherein the insert radially surrounds the center charging contact and holds the center charging contact and the annular charging contact in a fixed position at the tip relative to the shell, and wherein annular groove is formed in the annular charging contact;

providing a light disposed behind the insert, the light being operatively coupled to the charging circuit, and the insert being one of transparent or translucent to permit the light to be visible through the insert when activated;

providing a charger assembly arranged for connection to a power source, the charger assembly having a cavity arranged to receive the forward portion of the shell, the charger assembly including a first electrical contact disposed within the cavity and positioned to engage the center charging contact, the charger assembly further including a second electrical contact disposed within the cavity and positioned to engage the annular charging contact, and the charger assembly includes a detent arranged to engage the annular groove when the tip is disposed in the cavity of the charger assembly;

coupling the charger assembly to a power source; and inserting the forward portion of the shell having the tip into the cavity of the charger assembly to bring the detent into engagement with the annular groove and to bring the center and annular charging contacts of the tip into engagement with the first and second electrical contacts, respectively, of the charger assembly to charge the battery.

14. The method of claim 13, including providing cooperating magnets adjacent the tip and the cavity and arranged to releasably secure the forward portion of the shell in the cavity.

15. The method of claim 13, including arranging the mouthpiece to be removable from the shell, and inserting the tip into the charger assembly with the mouthpiece attached to the shell.

16. The method of claim 13, including providing an air flow path from the shell, through the cartomizer, and to an aperture adjacent a rearward portion of the mouthpiece, providing the cartomizer in the mouthpiece, and arranging the cartomizer to receive power from the battery via the switch assembly.

17. The method of claim 13, including providing a forward portion of the mouthpiece with an inner contact and an outer contact isolated from one another and electrically coupled to the cartomizer, providing a rearward portion of the shell with an inner contact and an outer contact electrically isolated from one another and electrically coupled to the switch assembly, and arranging the inner and outer contacts of the mouthpiece and the shell to contact one another upon attaching the mouthpiece to the shell.

18. The method of claim 17, including routing the air flow path through the inner contact of the mouthpiece and the inner contact of the shell.

19. A tip charging electronic cigarette comprising:

a cigarette body, the cigarette body including a shell and a mouthpiece, the shell having a forward portion terminating in a tip;

the cigarette body further including a battery, a charging circuit operatively coupled to the battery, and a cartomizer operatively coupled to a switch assembly, wherein the battery is carried by the shell, and the cartomizer is carried by the mouthpiece so as to be separable from the shell and the battery upon removing the mouthpiece from the shell;

a center charging contact carried by an insert and disposed adjacent the tip, wherein the insert radially surrounds the center charging contact;

an annular charging contact disposed adjacent the tip and defining an outer annular periphery of the tip, the annular charging contact radially surrounding and carrying the insert and being separated from the center charging contact by the insert, the insert being electrically non-conductive, such that the center charging contact and the annular charging contact are electrically insulated from one another, wherein the insert holds the center charging contact and the annular charging contact in a fixed position at the tip relative to the shell;

the center charging contact and the annular charging contact operatively coupled to the charging circuit;

the center charging contact and the annular charging contact arranged for connection to cooperating electrical contacts of a charger assembly;

a light disposed behind the insert, the light being operatively coupled to the charging circuit, and the insert being one of transparent or translucent to permit the light to be visible through the insert when activated;

wherein the battery is arranged to be charged upon engaging the tip with the charger assembly;

wherein the forward portion of the shell includes an annular groove, wherein the annular groove is formed in the annular charging contact, and wherein the annular groove is sized and positioned to be engaged by a detent carried by the charger assembly.

20. The tip charging electronic cigarette of claim 19, wherein the forward portion of the mouthpiece is removably coupled to the rearward portion of the shell, wherein the cigarette body includes an air flow path extending from the shell, through the cartomizer, and to an aperture adjacent the rearward portion of the mouthpiece, and wherein the cartomizer is disposed in the mouthpiece and is arranged to receive power from the battery via the switch assembly.

21. The tip charging electronic cigarette of claim 20, wherein the forward portion of the mouthpiece includes an inner contact and an outer contact, the inner and outer contact of the mouthpiece electrically isolated from one another and electrically coupled to the cartomizer, and wherein the rearward portion of the shell includes an inner contact and an outer contact electrically isolated from one another and electrically coupled to the switch assembly, the inner and outer contacts of the mouthpiece and the shell arranged to contact one another when the mouthpiece is attached to the shell.

22. The tip charging electronic cigarette of claim 21, wherein the air flow path extends through the inner contact of the mouthpiece and the inner contact of the rearward portion of the shell.

23. The tip charging electronic cigarette of claim 19, wherein the charging circuit is arranged to receive power via a USB connector.

24. The tip charging electronic cigarette of claim 19, wherein forward portion of the shell adjacent the tip includes a magnet arranged to interact with a magnet of the charging assembly.

25. The tip charging electronic cigarette of claim 19, wherein the battery, the charging circuit, and the cartomizer are disposed in the shell, and wherein the switch assembly comprises a pressure sensor disposed in an air flow path.

* * * * *